US006318845B1

(12) United States Patent
Mizutani

(10) Patent No.: US 6,318,845 B1
(45) Date of Patent: Nov. 20, 2001

(54) INK-JET PRINTING APPARATUS AND METHOD FOR VARYING ENERGY FOR INK EJECTION FOR HIGH AND LOW EJECTION DUTIES

(75) Inventor: Michinari Mizutani, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/349,112

(22) Filed: Jul. 8, 1999

(30) Foreign Application Priority Data

Jul. 10, 1998 (JP) ..... 10-196386

(51) Int. Cl.[7] ..... B41J 2/05
(52) U.S. Cl. ..... 347/57; 347/60
(58) Field of Search ..... 347/56, 57, 58, 347/59, 60, 5, 9, 10, 11, 14

(56) References Cited

U.S. PATENT DOCUMENTS 4,491,851 * 1/1985 Mizuno et al. ..... 347/11
5,305,024 * 4/1994 Moriguchi et al. ..... 347/11
5,808,632 * 9/1998 Miura et al. ..... 347/60

FOREIGN PATENT DOCUMENTS 4-10940 1/1992 (JP) .
4-10941 1/1992 (JP) .
4-10942 1/1992 (JP) .

* cited by examiner

*Primary Examiner*—John Barlow
*Assistant Examiner*—Juanita Stephens
(74) *Attorney, Agent, or Firm*—Fitzpatrick, Cella, Harper & Scinto

(57) ABSTRACT

Energy applied to a heater for ejecting an ink is set to more than bubble generation threshold energy Eth and less than predetermined energy Eo, or to more than the predetermined energy Eo. Thereby, when an image to be printed is one of low ejection duty, an ejection where a bubble communicates with the atmosphere before the ink droplet separates from an ejection port (BTHJ ejection) is performed. On the other hand, when the image is one of high ejection duty, an ejection not communicating with the atmosphere as above (BUBBLE-JET ejection) is performed. As a result, an increase of ink mist due to satellites can be suppressed as a whole even if satellites are increased because of BTHJ ejection. When the ejection duty is high, generation of satellites themselves is reduced, thereby suppressing increase of ink mist.

14 Claims, 8 Drawing Sheets

INK-JET PRINTING APPARATUS AND METHOD FOR VARYING ENERGY FOR INK EJECTION FOR HIGH AND LOW EJECTION DUTIES

This application is based on Patent Application No. 196,386/1998 filed on Jul. 10, 1998 in Japan, the content of which is incorporated hereinto by reference.

BACKGROUND OF THE INVENTION

1. FIELD OF THE INVENTION

The present invention relates to an ink-jet printing apparatus and an ink-jet printing method, and more specifically to reduction of an ink mist generated in association with ink ejection.

2. DESCRIPTION OF THE PRIOR ART

Recently, color printing, high-speed printing and high-quality printing in ink-jet printing methods have been remarkably improved. Also, the spread of Internet communications, digital cameras and the like has increased a demand for photographic quality color printing.

As methods capable of achieving such high-resolution, high-gradation, and high-quality printing in an ink-jet printing method, following are known:

(1) A method in which a size of a nozzle for ejecting ink is reduced to increase a nozzle arrangement density in a printing head, and a size of an ink droplet itself ejected from the nozzle is decreased to print a small-sized dot, thereby improving the resolution of a printed image.

(2) A method in which, without increasing the nozzle arrangement density, a plurality (at least two) of heads including a head for ejecting a high-concentration ink and a head for ejecting a light ink lower in concentration than the above high-density ink are prepared for one color. Overlaying one of these inks with another is performed as necessary, thereby improving gradation of a printed image to increase the quality of the image.

(3) A method in which, without increasing the nozzle arrangement density, an amount of ink ejected from nozzles is made variable to change a size of a printed dot in a relatively large range, thereby improving gradation to increase image quality.

However, it is said that the above method (3) is generally difficult to be executed in a so-called bubble-jet system (hereinafter also referred to as BUBBLE-JET system) in which a bubble is formed in ink by means of a thermal energy generation element and the ink is ejected by the pressure of the bubble generation.

On the other hand, the above method (2) causes a problem such that the number of printing heads used is increased so that a cost of an apparatus may be increased in the case that a number of types of concentrations for a single color is increased to more than two types. For this reason, it is common to use two types of inks of dark and light for a single color. In this case, since a number of density gradation levels is restricted to a small number, there is a limitation in pursuing high image quality.

In view of the above discussion, a method such as the above-stated method (1), in which printing is performed by ejecting a relatively small ink droplet from a single nozzle, has an advantage in improving image quality in the BUBBLE-JET system. As a method for ejecting such a small liquid droplet (less than 10 pl in ejection volume), a method belonging to a kind of the BUBBLE-JET system is known in which a generated bubble is communicated with an outer atmosphere in a vicinity of an ejection port before an ink droplet separates from the ejection port (hereinafter this method is referred to as "bubble-through system" or "BTHJ system"). For example, this type of method is described in Japanese Patent Application Laid-open No. 10940/1992, Japanese Patent Application Laid-open No. 10941/1992, Japanese Patent Application Laid-open No. 10742/1992 or the like. It should be noted that, hereinafter, only a method of the BUBBLE-JET system except the BTHJ system, that is, a method for performing ejection without communicating with ambient air in the vicinity of the ejection port, is referred to as the BUBBLE-JET system.

In the BUBBLE-JET system, in order to make the ejected ink droplet as small as possible, it is necessary to make thinner a liquid passage communicating with the ejection port from which the ink droplet is ejected. In this case, ejection efficiency is deteriorated or an ejection speed is decreased. When the ejection speed is decreased as above, an ejection direction or an ejection amount becomes unstable. Furthermore, this decreasing of the ejection speed easily causes an unstable ejection, an initial ejection failure, or the like, which are caused by an effect of viscosity increase due to evaporation of ink moisture during a non-ejection state of the printing head. This results in a reliability problem.

On the other hand, the BTHJ system is suitable for ejecting the small liquid droplets. Furthermore, since mainly a geometrical shape of the nozzle determines the amount of ejected liquid droplets or the like, the BTHJ system has an advantage that it is not easily affected by temperature or the like and the ejection amount of the liquid droplets is relatively stable as compared with the BUBBLE-JET system.

However, in general, as the size of liquid droplets ejected from the nozzle decreases, the number of ink application times required for covering a predetermined printing area increases. As a result, an amount of ink satellites generated in association with ejection of an ink droplet increases with an increase in the number of application times. Further, the increase in the number of ink application times may result in a reduction of a throughput of an apparatus. In order to make up for the reduction, an increase in a number of the nozzles may be considered. However, this further increases generation of the satellites.

As described above, when the amount of the satellites increases, a problem occurs in that a mist in the apparatus increases and, in the worst case, the mist adheres to an electrical contact part, which results in an inferior operation of the printing apparatus. Even when the liquid droplet size is not so small, in a case when using two printing heads of dark and light by combining the above-stated method (1) and method (2), the ejected satellite amount likewise increases because the number of heads is increased. Thus, the same problem occurs.

SUMMARY OF THE INVENTION

An object of the present invention is to provide an ink-jet printing apparatus and an ink-jet printing method which can suppress the increase of an ink mist in association with the improvement of image quality.

The present invention has been achieved on a basis of the following characteristics of the ink satellite in both the BUBBLE-JET system and the BTHJ system which are investigated by the inventor of the present invention.

FIGS. 1A, 1B, 1C and 1D are schematic diagrams showing the process of an ink droplet ejected in the BUBBLE-JET system with the passage of time. On the other hand, FIGS. 2A, 2B, 2C and 2D are schematic diagrams showing the same process in the BTHJ system. In FIGS. 1A to 1D and 2A to 2D, reference numeral 4 indicates an ink ejection port, 11 is a main droplet of the ejected ink, and 12 is ink satellites, respectively.

In the BTHJ system, all of the ink existing in front of a heater is ejected, in principle. Further, since this system does not have a process for reducing a bubble as the BUBBLE-JET system has, timing for a main droplet to separate from the ejection port is faster as compared with the BUBBLE-JET system. As described above, in the BTHJ system, the satellite is not generated in principle since the ink in front of the heater is all ejected. However, in a real state of ejection, a part of ink remains on a wall surface of the ejection port and is pulled by the main droplet to thread a tail as shown in FIG. 2A. The BTHJ system is characterized in that a size of tail $d_{BTJ}$ is smaller than that in the BUBBLE-JET system ($d_{BJ}$ as shown in FIG. 1A). At a time point shown in FIG. 2B, the tail is drawn by an effect of the ejection speed of the main droplet part so that a length of the tail becomes longer. Then, at the time of overcoming a surface tension, which causes the tail and the main droplet part to be united, the tail is divided into a plurality of satellites as shown in FIG. 2C. The thus formed satellites 12 (FIG. 2D) in the BTHJ system are in general larger in number and smaller in size than satellites 12 (FIG. 1D) in the BUBBLE-JET system. In the BUBBLE-JET system, since the tail is larger in thickness as shown in FIG. 1A, the satellite part is not easily divided into a plurality of pieces so that the satellites become small in number.

As shown above, in the BUBBLE-JET system, the size of each satellite is about 0.1 to 6 pl in volume. On the other hand, satellite volume in the BTHJ system is about 0.01 to 0.5 pl, which is characteristically smaller than in the BUBBLE-JET system and larger in number.

In a first aspect of the present invention, there is provided an ink-jet printing apparatus using a printing head having an ejection port and a thermal energy generating element for generating thermal energy according to an applied energy to eject ink from the ejection port by pressure from a bubble generated in the ink by the thermal energy and performing printing, the apparatus comprising:

means for controlling the energy applied to the thermal energy generating element correspondingly to an ejection duty obtained based on image data. The means controls the energy applied to the thermal energy generating element to be relatively small when the ejection duty is high so as to perform ink ejection in a state in which the ink does not communicate with atmosphere. The means controls the energy applied to the thermal energy generating element to be relatively great when the ejection duty is low so as to perform ink ejection in a state in which the ink communicates with the atmosphere.

In a second aspect of the present invention, there is provided an ink-jet printing method using a printing head having an ejection port and a thermal energy generating element for generating thermal energy according to an applied energy to eject ink from the ejection port by pressure from a bubble generated in the ink by the thermal energy and performing printing, the method comprising the steps of:

causing the printing head to eject ink in a state that the bubble generated in the ink does not communicate with atmosphere when an ejection duty obtained based on image data is high; and causing the printing head to eject ink in a state that the bubble generated in the ink communicates with the atmosphere when the ejection duty is low, thereby performing the printing.

According to the above structure, when the ejection duty is low, ink is ejected in a system in which a bubble in the ink communicates with the atmosphere (the BTHJ system). Here, since the ejection duty is low, an amount of generated satellites is small as a whole. Further, since the ejected small liquid droplet is uniform in volume and small in size, a high-quality image can be obtained without conspicuous particle forms or unevenness.

On the other hand, when the ejection duty is high, since ink is ejected in a system in which the bubble is not communicated with the atmosphere (the BUBBLE-JET system), the generation of satellites per se can be reduced. In the ease of ink ejection by means of the BUBBLE-JET system, there is a fear that the ejection volume is not uniform. However, since the ejection duty is high, a discretely formed dot nearly does not exist or is not a problem in terms of image quality. Further, reduction of throughput can also be prevented.

The above and other objects, effects, features and advantages of the present invention will become more apparent from the following description of embodiments thereof taken in conjunction with the accompanying drawings.

BRIEF DESCRIPTION OF THE DRAWINGS

FIGS. 6A and 6B respectively show drive pulses applied to the thermal energy generation element, in which FIG. 6A is a diagram showing a single pulse, and FIG. 6B is a diagram showing a double pulse having a pre-pulse;

DETAILED DESCRIPTION OF THE PREFERRED EMBODIMENTS

In the following, embodiments of the present invention will be described in detail with reference to the drawings.

(Embodiment 1)

Figures 1A, 1B, 1C, 1D:
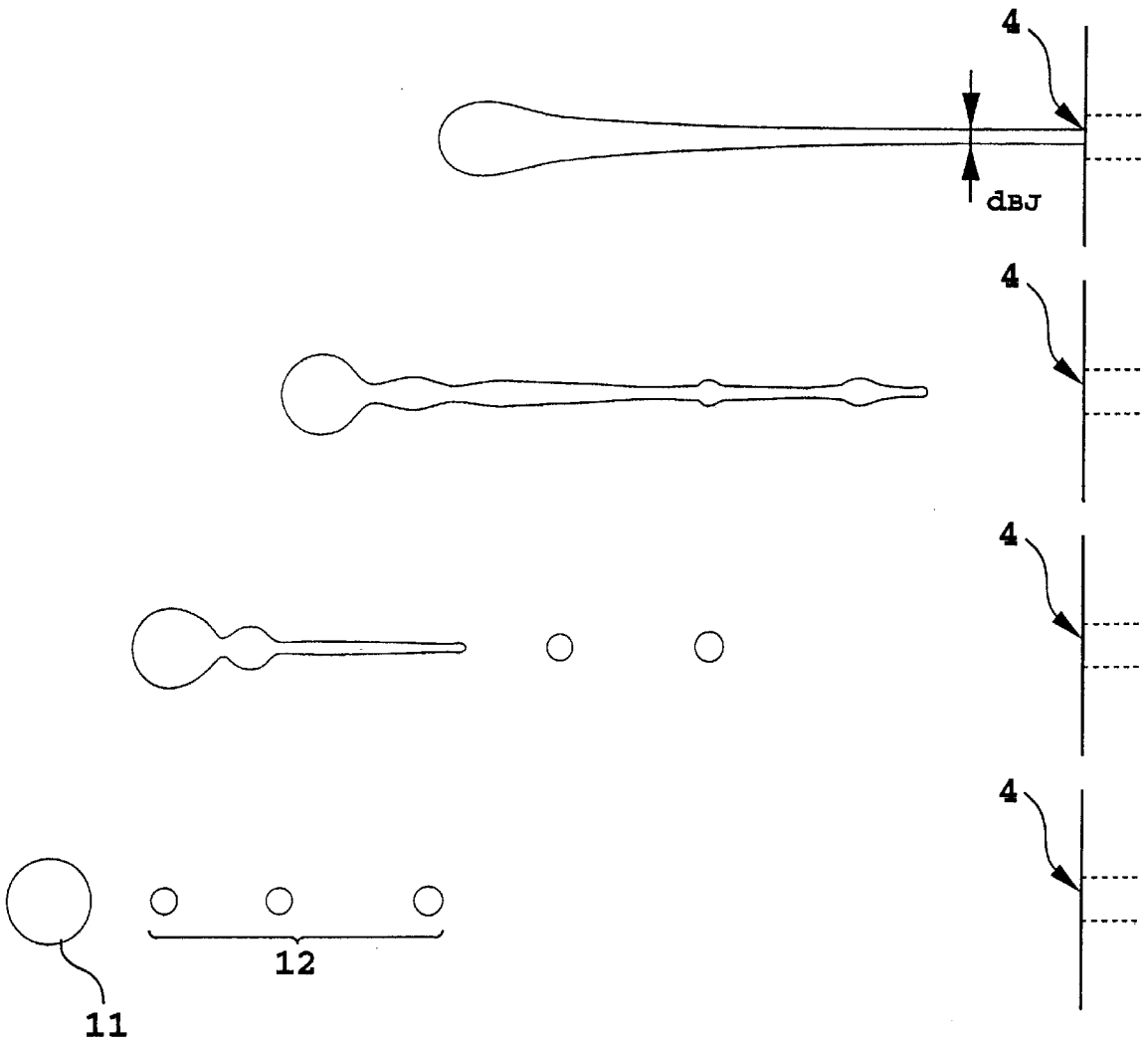
FIGS. 1A to 1D are diagrams showing a state of an ink droplet and satellites during BUBBLE-JET ejection with passage of time.
Figures 2A, 2B, 2C, 2D:
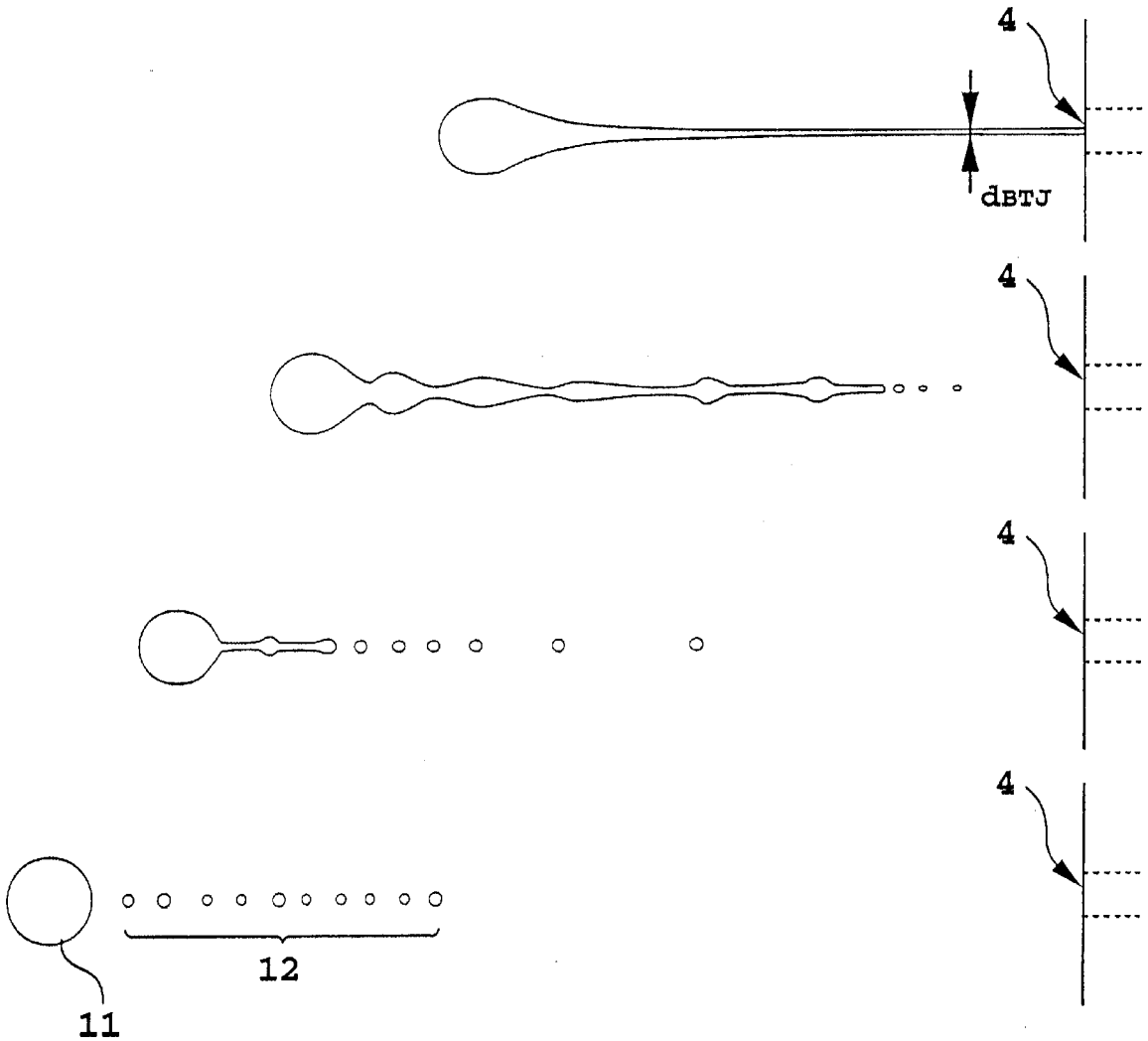
FIGS. 2A to 2D are diagrams showing a state of ink droplet and satellites during BTHJ ejection with passage of time.
Figure 3A:
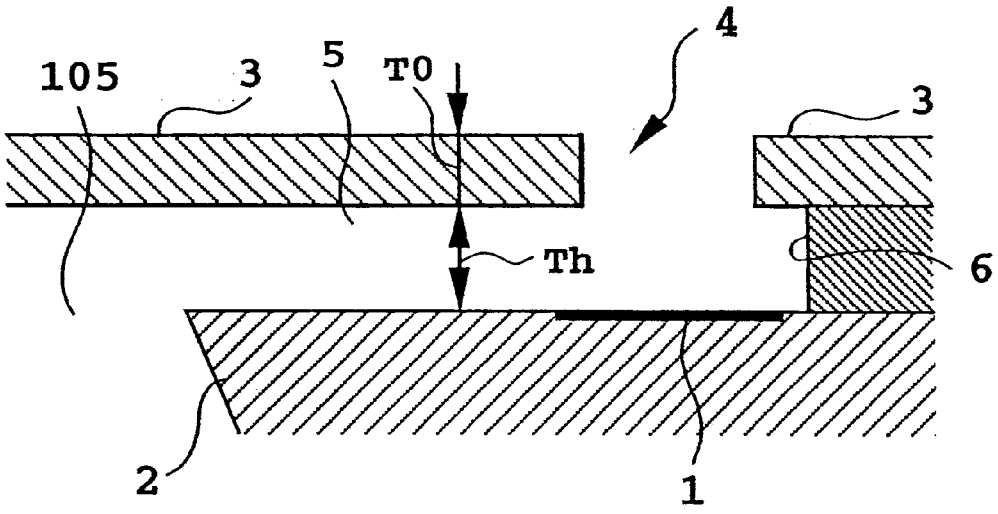
FIG. 3A is a schematic sectional diagram showing the construction of a part of an ink-jet printing head according to an embodiment of the present invention.
Figure 3B:
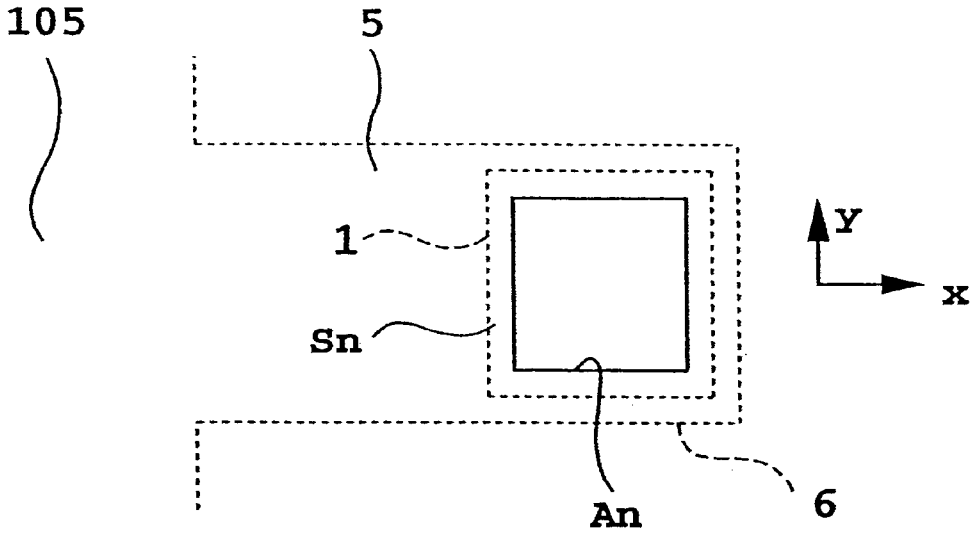
FIG. 3B is a front diagram of the construction.

FIGS. 3A and 3B are diagrams schematically illustrating a construction of an ink-jet printing head according to the present embodiment. FIG. 3A is a sectional illustration of an ink ejection port as viewed from the side, and FIG. 3B is a front illustration of the ejection port as viewed from the front.

In the ink-jet printing head of the present embodiment, 256 ejection ports are arranged in a density of 600 dpi, and the volume of an ink droplet ejected from each ejection port is 8.5 pl. At a predetermined position on a device substrate 2, a rectangular heater 1 as an electro-thermal conversion element is provided. On an upper part of the substrate 2, an orifice plate 3 is disposed in parallel with the substrate, and the orifice plate 3 has an ejection port 4 opening in rectangular form at a position opposing the heater 1. A communicating passage 105 and a liquid flow passage 5 communicating therewith are formed of spaces surrounded by the substrate 2, the orifice plate 3 and a liquid flow passage wall 6. As shown in FIG. 3B, the liquid flow passage 5 extends in an x direction shown in the same figure, and in this case, the ejection port 4 is arranged in a y direction in a plurality of units. Further, the printing head of the present embodiment has the same construction as that shown in FIGS. 3A and 3B which are symmetrical with respect to an axis of the y direction. That is, arrays of ejection ports 4 arranged in the y direction are formed in two rows.

Figure 4:
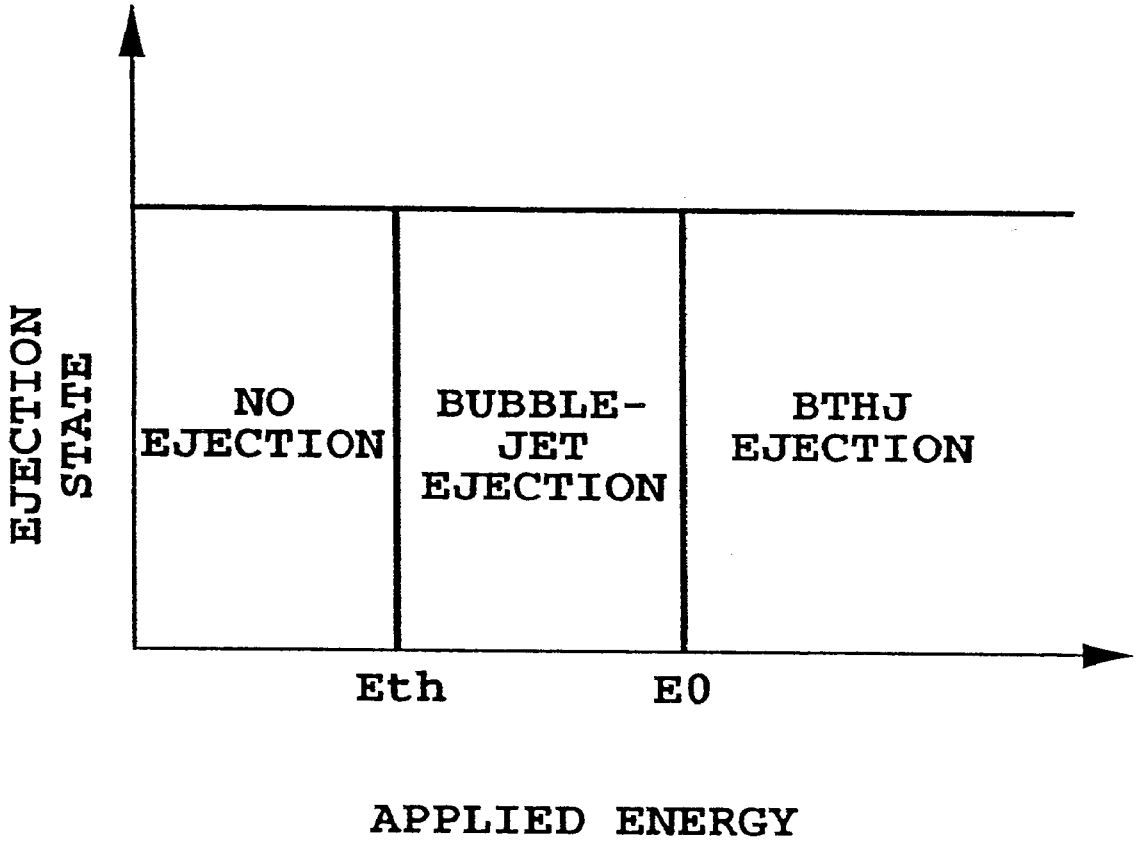
FIG. 4 is a diagram showing a relation between applied energy to a thermal energy generation element and an ejection state.

Next will be described, as to the present embodiment, a control of ejection by the above BTHJ system (hereinafter referred to as "BTHJ ejection") and ejection by the BUBBLE-JET system (hereinafter referred to as "BUBBLE-JET ejection"), which control is executed through an applied energy of a voltage pulse applied to the heater 1. FIG. 4 is a diagram for explaining a concept of the control.

Figure 5A:
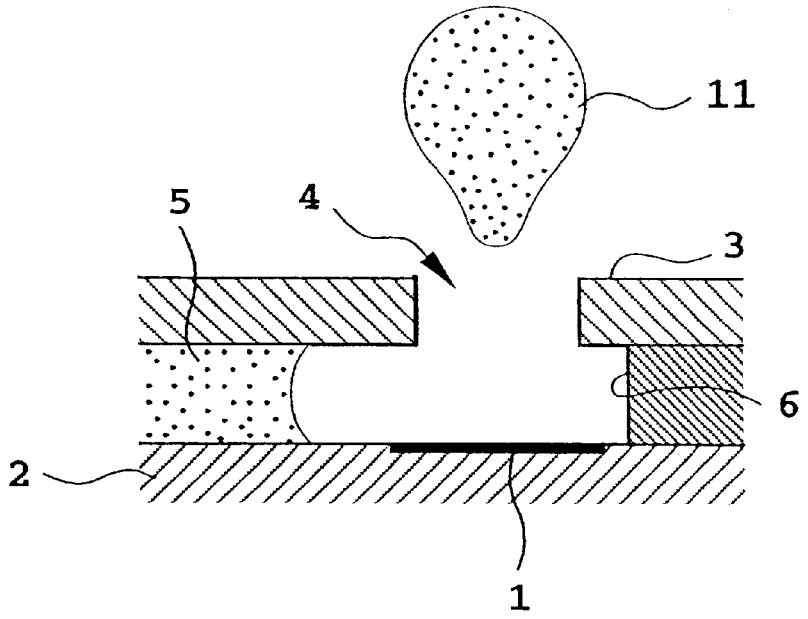
FIG. 5A is a schematic diagram showing a vicinity of an ejection port in the BTHJ ejection of an ink-jet printing head as viewed from the side surface.
Figure 5B:
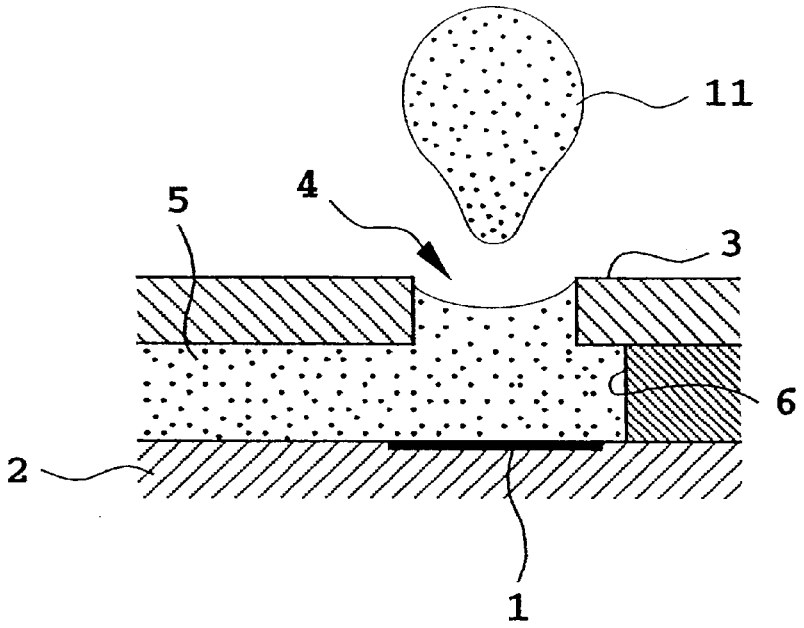
FIG. 5B is a schematic diagram showing a vicinity of an ejection port in the BUBBLE-JET ejection as viewed from the side surface.

In FIG. 4, Eth is a bubble generation threshold energy or an ejection lower limit energy. When the applied energy to the heater 1 is equal to or smaller than the Eth, bubble generation required for ink ejection is not obtained and the ink is not ejected. Further, when the applied energy is higher than Eo, as shown in FIG. 5A, the ink present in front of the heater 1 in an ejection direction is supplied with an energy sufficient for ejecting almost all of the ink, thus achieving the BTHJ ejection. On the other hand, when the applied energy is smaller than Eo, since an energy required for ejecting all of the ink in front of the heater 1 is not obtained, the BUBBLE-JET ejection state occurs as shown in FIG. 5B. In this case, an applied energy E for the BUBBLE-JET ejection has a relation of $1^2<E/Eth<(1.1)^2$, where $Eo/Eth=(1.1)^2$.

Distinguishing between a state of the BTHJ ejection and a state of the BUBBLE-JET ejection can be easily made by observing as to whether ink remains in a part from the heater 1 to the ejection port 4 in the ejection direction, as shown in FIGS. 5A and 5B. More specifically, as in the case shown in FIG. 5A, when no ink remains in front of the heater 1, it is determined that BTHJ ejection is performed, and when ink remains as shown in FIG. 5B, it is determined that BUBBLE-JET ejection is performed.

In an embodiment of the present invention, the control for selecting the BUBBLE-JET ejection and the BTHJ ejection as described above is performed according to a printing duty of the image. Here, a high-duty part in image data used in the control is defined. The high-duty part refers to a part in a predetermined area in binary image data, in which at least a half of pixels of the area have ON (ejection) data. On the other hand, a low-duty area refers to a part in which less than half of the pixels have ON data. In the ink-jet printing apparatus of the present embodiment, the high duty or the low duty is distinguished according to whether the number of ejected pixels are more or less than ½ in the predetermined printing area as described above. However, it is a matter of course that the criterion is not limited to ½. It is possible that mist state is previously checked at several duties, and the determination criterion may be determined according to the result of checking.

Figure 6A:
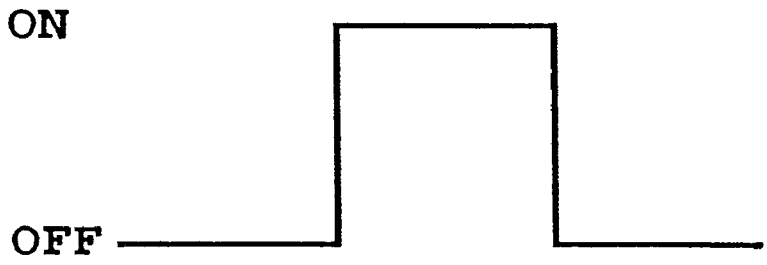
Figure 6B:
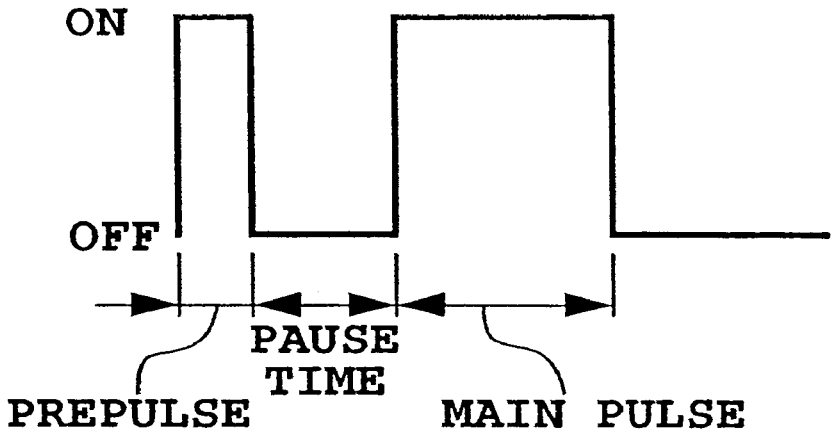

Next, practical means for changing applied energy in the above control will be described. In the BUBBLE-JET system or the BTHJ system according to the present embodiment, a form of voltage pulse applied to the heater can vary the applied energy. The applied energy differs between respective cases when only a single pulse is applied (hereinafter referred to as "single pulse") as shown in FIG. 6A and when a short pulse (hereinafter referred to as "pre-pulse") to an extent not to generate a bubble is added to an ejection pulse (hereinafter referred to as "main pulse") as shown in FIG. 6B (hereinafter referred to as "double pulse"). The double pulse is greater in applied energy than the single pulse. The time between a falling edge of the pre-pulse and a rising edge of the main pulse of the double pulse is referred to a pause time.

In the head construction of the present embodiment, a flow passage height Th shown in FIG. 3A is 13 $\mu$m, a thickness To of the orifice plate is 12 $\mu$m, a heater size is a square of 26 $\mu$m, and a heater area Sn is 676 $\mu m^2$. An ejection port area An shown in FIG. 3B is 400 $\mu m^2$, and when a voltage of 9 V is applied to the heater, a volume ejected from the head is 8.5 pl in BTHJ system.

During the low duty printing, driving the head is performed by means of the double pulse in which a voltage is 9 V, a pre-pulse width is 0.5 $\mu$sec, a pause time is 1.0 $\mu$sec and a main pulse width is 1.6 $\mu$sec. This provides the BTHJ ejection state as shown in FIGS. 2A to 2D. During the high duty printing, on the other hand, driving the head is performed by means of the single pulse with a width of 1.9 $\mu$sec at a voltage of 9 V. This provides the BUBBLE-JET ejection state as shown in FIGS. 1A to 1D. As shown above, the BTHJ ejection is performed during the low duty printing, and thereby the ink droplet ejected from the head is made relatively small and its volume is maintained at a constant value so that a printed image with a high resolution and without unevenness can be obtained. In addition, since printing is performed at low-duty, the total satellite amount can be reduced and the mist amount in the apparatus can be reduced. On the other hand, in the high duty where a discretely formed dot almost does not exist, the BUBBLE-JET ejection is performed. Thereby, the satellite per se is decreased and likewise the mist amount can be reduced. Further, the number of application times of ink is not necessarily increased, and decreasing of the throughput can be prevented.

According to an investigation by the inventor of the present invention, a switching condition between the BTHJ ejection and the BUBBLE-JET ejection performed by increasing or decreasing the pulse width in the present embodiment is closely related to a nozzle construction of the head.

More specifically, the condition whether the BTHJ ejection occurs or not is closely related to relations between a forward inertance of a part from the heater 1 to the ejection port 4 in the ejection direction and a backward inertance of a part behind the heater 1 in a direction of the liquid flow passage 5 in the head construction shown in FIG. 3A. The smaller the thickness To is, that is, the thinner the orifice plate is, the smaller the forward inertance becomes so that the BTHJ ejection occurs more easily. Also, the smaller the flow passage height Th is, similarly the greater the backward inertance becomes so that the BTHJ ejection occurs more easily because an ejection power caused by the heater does not escape. On the other hand, the greater the thickness To is, the greater the forward inertance becomes so that the BTHJ ejection is hard to occur. The greater the height Th is, the smaller the backward inertance becomes so that the ejection power escapes to make the BTHJ ejection hard to occur.

A following expression can be realized in a head construction in which the switching between the BTHJ ejection and the BUBBLE-JET ejection can be achieved by increasing or decreasing the pulse width.

$$0.5<To/Th<1.5$$

The case where the To/Th becomes smaller than 0.5 occurs in both a case that the thickness To is extremely small and a case that the height Th is extremely great. Actually, the former case cannot be realized because the thickness of the orifice plate cannot be made thin of the order of several μm due to restrictions in the manufacturing of the head. Therefore, it is not actual that the BTHJ ejection stably occurs in a condition where the thickness of the orifice plate is extremely thin and the forward inertance is almost zero. Next, in the latter case, since the height Th is large, the backward inertance becomes small so that the ejection power cannot concentrate and escapes in the backward direction of the liquid flow passage.

Further, in a case where the To/Th becomes greater than 1.5, the BTHJ ejection does not easily occur because the forward inertance becomes extremely greater.

Comparative example 1 using a head in which To is 15 μm and Th is 12 μm also makes the BTHJ ejection occur by switching the pulse width similarly to Embodiment 1. However, Comparative example 2 using a head in which To is 18 μm and the Th is 12 μm cannot.

Furthermore, Comparative example 3 using a head in which To is 9 μm and Th is 16 μm also makes the BTHJ ejection occur by switching the pulse width similarly. However, Comparative example 4 using a head in which To is 9 μm and Th is 18 μm cannot realize the stable BTHJ ejection.

It is preferable in the present invention that To+Th has a value in a range from 20 μm to 30 μm as a condition for the stable BTHJ ejection. Reasons for why ranges except the above-stated range are not preferable are as follows.

In a case that Th is less than 10 μm, a response frequency is decreased. In a case that To is less than 6 μm, stiffness of the orifice plate cannot be formed. In a case that the To+Th is extremely great, exceeding 30 μm, only the ordinary BUBBLE-JET ejection easily occurs.

(Embodiment 2)

A printing head of the present embodiment has a construction in which To shown in FIG. 3A is 9 μm and Th is 12 μm. A heater size is a rectangle of 26 μm×31 μm, and Sn is 806 $\mu m^2$. An, shown in FIG. 3B, is 400 $\mu m^2$, and when a voltage of 10 V is applied to the heater, a volume ejected from the head is 5 pl in the BTHJ system.

In the present embodiment, the above-described single pulse driving is performed in both cases of the BUBBLE-JET system and the BTHJ system, and increasing or decreasing the pulse width changes the applied energy to the heater. That is, during the low duty printing, driving the head is performed at a voltage of 10 V with a pulse width of 2.3 μsec. This provides the BTHJ ejection state as shown in FIGS. 2A to 2D. During the high duty printing, on the other hand, driving the head is performed by means of a single pulse at a voltage of 10 V with a pulse width of 1.8 μsec so as to perform the BUBBLE-JET ejection as shown in FIGS. 1A to 1D. A bubble generation threshold pulse width or an ejection lower limit pulse width Pth is 1.5 μsec and a driving pulse P during the BUBBLE-JET ejection satisfies a condition of $1^2<P/Pth<(1.1)^2$. By making the BTHJ ejection caused during the low duty printing and, on the other hand, by making the BUBBLE-JET ejection caused during the high duty printing, as in the first embodiment, the satellites can be decreased to reduce mist generation in the apparatus.

(Embodiment 3)

In embodiment 3, the driving voltage is increased or decreased as means for changing the applied energy to the heater. That is, during the low duty printing, driving the head is performed by means of a single pulse at a voltage of 10 V with a pulse width of 2.3 μsec. This provides the BTHJ ejection state as shown in FIGS. 2A to 2D. During the high duty printing, on the other hand, driving the head is performed by means of a single pulse at a voltage of 9 V with a pulse width of 2.3 μsec to perform the BUBBLE-JET ejection as shown in FIGS. 1A to 1D. In this case, a driving voltage V used during the BUBBLE-JET ejection satisfies a relation of 1<V/Vth<1.1. As described above, by making the BTHJ ejection performed during the low duty printing and, on the other hand, by making the BUBBLE-JET ejection performed during the high duty printing, the same effect as the above-described two embodiments can be obtained.

Figure 7:
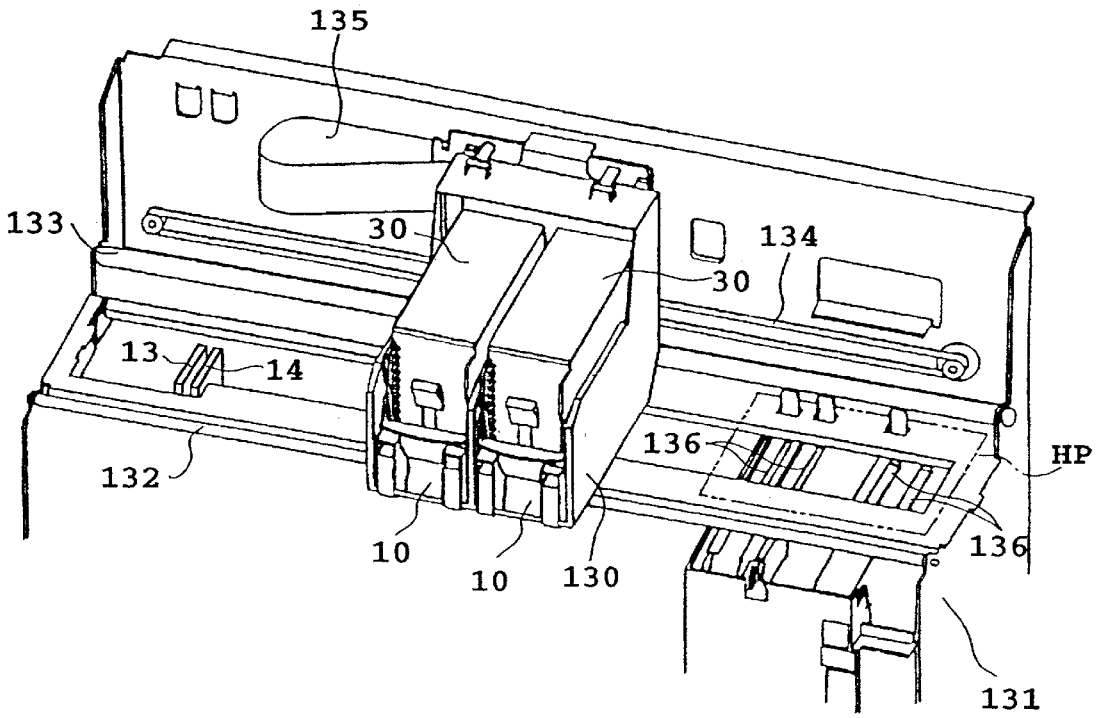
FIG. 7 is a schematic perspective view showing an ink-jet printing apparatus according to an embodiment of the present invention.

FIG. 7 is a perspective view showing an example of an ink-jet printing apparatus according to the above-described respective embodiments.

In FIG. 7, a reference numeral 130 indicates a carriage capable of mounting two units, each of which has the above-described ink-jet printing head and an ink cartridge. Of the two ink-jet heads, one is provided with a predetermined number of ejection ports for ejecting each of cyan, magenta and yellow inks, which ejection ports are integrally formed, and corresponding to the above construction of the head, the ink cartridge stores the above three types of ink separately. Further, the other ink-jet head ejects a black ink, and corresponding to this construction, the other ink cartridge stores the black ink. The carriage 130 is slidably supported by guide rails 132 and 133 which are supported at both ends thereof on a chassis 131 and extend thereacross. The carriage 130 is connected with a driving belt 134 for transmitting driving force from a drive motor (not shown) and a flexible cable 135 for transmitting an image signal to the respective mounted heads 10. By this structure, ink is ejected from each ink-jet head 10 to, for example, printing paper as a printing medium to perform printing.

At a home position HP provided at one end side of a carriage moving area, a cap (capping means) 136 is provided which is used for suction and protection for the purpose of ejection recovery operation for the ink-jet head mounted on the carriage 130. By causing a space between the cap 136 and the head part covered with the cap 136 to be at a negative pressure by a pump (pump means) (not shown), or causing the heads to perform a preliminary ejection into the cap 136, clogging or the like of the ejection port or ink flow passage (nozzle) communicating with the ejection port in the head part can be positively eliminated. Although not shown, the cap 136 is provided with an ink tube communicating with its inside for conducting ink removed from the head to a predetermined part.

Figure 8:
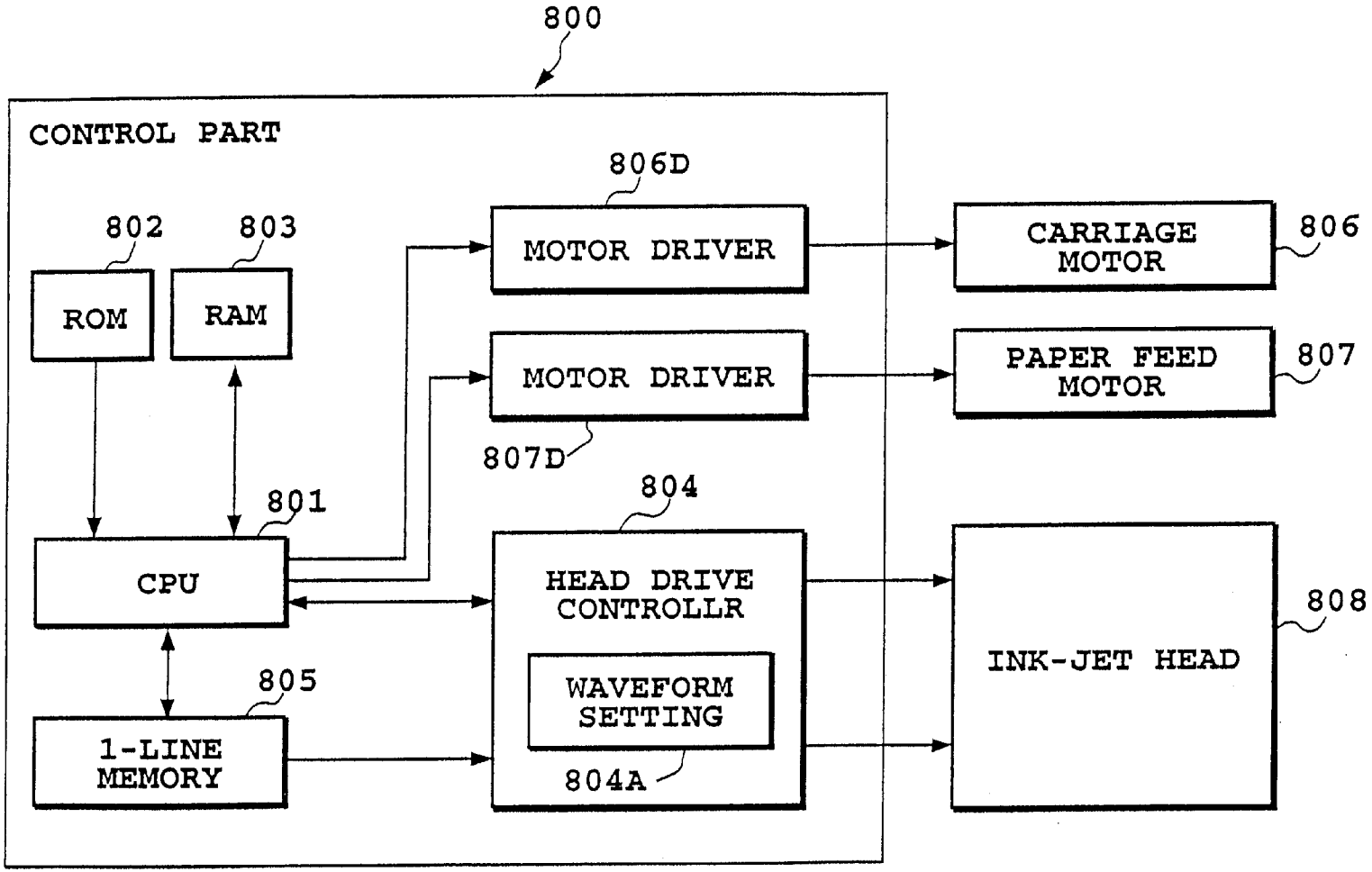
FIG. 8 is a block diagram showing a control arrangement of the ink-jet printing apparatus shown in FIG. 7.

FIG. 8 is a block diagram showing a control arrangement of the ink-jet printing apparatus shown in FIG. 7.

A control part 800 has a CPU 801 for executing printing data processing, operation control of various mechanisms and the like, thereby performing control of the present printing apparatus. A ROM 802 stores a processing program used by the CPU 801, and a RAM 803 is used as a work area for processing execution by the CPU 801. Further, the CPU 801 is able to control driving of a carriage motor 806 and a paper feed motor 807 through motor drivers 806D and 807D, respectively.

A head drive controller 804 according to control of the CPU 801 performs drive control of the respective ink-jet heads shown in FIG. 7. Specifically, the head drive controller 804, correspondingly to timing of movement of the carriage 130, supplies binary ejection data stored in a one-line memory to the driver for the ink-jet head 808 in correspondence to each ejection port on the ink-jet head 808, so that ink is ejected from the ink-jet head 808.

In the above-described first embodiment, when printing data of one line in a predetermined buffer is stored in the one-line memory 805 in the above drive control, the CPU 801 counts a number of ON (ejection) data, and stores the count result in a predetermined memory of the head drive controller 804. When the ejection data stored in the one-line memory is transferred to the ink-jet head 808, according to whether or not a duty obtained based on the counted number is more than a predetermined reference duty, as described above, a drive pulse waveform signal is sent from a waveform setting part 804A to the driver of the ink-jet head 808. Thereby, driving the heater can be performed by a driving pulse with a pulse width or voltage according to the duty.

As can be seen from the above description, according to each of the above-described embodiments, when the ejection duty is low, ink is ejected in a system in which a bubble in the ink communicates with the atmosphere (the BTHJ system). Here, since the ejection duty is low, an amount of generated satellites is small as a whole. Further, since the ejected small liquid droplet is uniform in volume and small in size, a high-quality image can be obtained without a conspicuous particle form or unevenness.

On the other hand, when the ejection duty is high, since ink is ejected in a system in which a bubble is not communicated with the atmosphere (the BUBBLE-JET system), generation of satellites per se can be reduced. In the case of ink ejection by means of the BUBBLE-JET system, there is a fear that the ejection volume is not uniform. However, since the ejection duty is high, a discretely formed dot nearly does not exist or is not a problem in terms of image quality. Further, reduction of throughput can also be prevented.

As a result, the mist amount discharged in the printing apparatus can be reduced while maintaining high speed and high image quality.

The present invention has been described in detail with respect to preferred embodiments, and it will now be apparent from the foregoing to those skilled in the art that changes and modifications may be made without departing from the invention in its broader aspect, and it is the intention, therefore, that the appended claims cover all such changes and modifications as fall within the true spirit of the invention.

What is claimed is:

1. An ink-jet printing apparatus using a printing head having an ejection port and a thermal energy generating element for generating thermal energy according to an applied energy to eject ink from the ejection port by pressure from a bubble generated in the ink by the thermal energy and capable of performing printing based on image data, the printing head having structure allowing a first ejection mode, in which ink ejection is performed in a state in which the bubble does not communicate with atmosphere, and a second ejection mode, in which ink ejection is performed in a state in which the bubble communicates with the atmosphere, to be switched in accordance with an amount of the energy applied to the thermal energy generating element, said apparatus comprising:

means for controlling the energy applied to the thermal energy generating element correspondingly to an ejection duty obtained based on the image data, said means controlling the energy applied to the thermal energy generating element to be made relatively small when the ejection duty is high so as to perform ink ejection of the first ejection mode and controlling the energy applied to the thermal energy generating element to be made relatively great when the ejection duty is low so as to perform ink ejection of the second ejection mode.

2. An ink-jet printing apparatus as claimed in claim 1, wherein the printing head has a construction to eject the ink after the bubble in the ink communicates with the atmosphere in a case that said means controls the energy applied to the thermal energy generating element when the ejection duty is low.

3. An ink-jet printing apparatus as claimed in claim 2, wherein said means controls the energy applied to the thermal energy generating element in a form of a pulse, and the energy is controlled by differing the form of the pulse.

4. An ink-jet printing apparatus as claimed in claim 3, wherein said means controls the energy by using a plurality of pulses including a combination of a pulse directly related to ink ejection with another pulse.

5. An ink-jet printing apparatus as claimed in claim 4, wherein a pulse when the ejection duty is low comprises the plurality of pulses including the combination of the pulse directly related to ink ejection with another pulse, and a pulse when the ejection duty is high comprises a single pulse.

6. An ink-jet printing apparatus as claimed in claim 2, wherein the energy (E) applied to the thermal energy generating element when the ejection duty is high satisfies an expression $$1^2 < E/Eth < (1.1)^2,$$

where Eth is an ejection lower limit energy required for ejection.

7. An ink-jet printing apparatus as claimed in claim 3, wherein a width P of a pulse applied to the thermal energy generating element when the ejection duty is high satisfies an expression $$1^2 < P/Pth < (1.1)^2,$$

where Pth is an ejection lower limit pulse width required for ejection.

8. An ink-jet printing method using a printing head having an ejection port and a thermal energy generating element for generating thermal energy according to an applied energy to eject ink from the ejection port by pressure from a bubble generated in the ink by the thermal energy and capable of performing printing based on image data, said method comprising the steps of:

causing the printing head to eject the ink in a state that the bubble generated in the ink does not communicate with atmosphere when an ejection duty obtained based on the image data is high; and causing the printing head to eject the ink in a state that the bubble generated in the ink communicates with the atmosphere when the ejection duty is low, thereby performing the printing.

9. An ink-jet printing method as claimed in claim 8, wherein the printing head has a construction to eject the ink after the bubble in the ink communicates with the atmosphere in a case that the energy is applied to the thermal energy generating element when the ejection duty is low.

10. An ink-jet printing method as claimed in claim 9, wherein said steps for causing ink ejection apply the energy to the thermal energy generating element in a form of a pulse, and control the energy by differing the form of the pulse to perform the ejection communicating with the atmosphere or the ejection not communicating with the atmosphere.

11. An ink-jet printing method as claimed in claim 10, wherein said steps for causing ink ejection control the energy by using a plurality of pulses including a combination of a pulse directly related to ink ejection with another pulse.

12. An ink-jet printing method as claimed in claim 11, wherein a pulse when the ejection duty is low comprises the plurality of pulses including the combination of the pulse directly related to ink ejection with another pulse, and a pulse when the ejection duty is high comprises a single pulse.

13. An ink-jet printing method as claimed in claim 9, wherein the energy (E) applied to the thermal energy generating element when the ejection duty is high satisfies an expression $$1^2 < E/Eth < (1.1)^2,$$

where Eth is an ejection lower limit energy required for ejection.

14. An ink-jet printing method as claimed in claim 10, wherein a width P of a pulse applied to the thermal energy generating element when the ejection duty is high satisfies an expression $$1^2 < P/Pth < (1.1)^2,$$

where Pth is an ejection lower limit pulse width required for ejection.

* * * * *

UNITED STATES PATENT AND TRADEMARK OFFICE

CERTIFICATE OF CORRECTION

PATENT NO. : 6,318,845 B1
DATED : November 20, 2001
INVENTOR(S) : Mizutani

It is certified that error appears in the above-identified patent and that said Letters Patent is hereby corrected as shown below:

Drawings,
SHEET 8 of 8, Figure 8, "CONTROLLR" should read -- CONTROLLER --.

Column 2,
Line 16, "is deteriorated" should read -- deteriorates --.

Column 3,
Line 11, "all" should read -- completely --.
Line 12, "ink" should read -- the ink --.

Column 4,
Line 13, "ease" should read -- case --.
Line 29, "ink" should read -- an ink --.

Column 5,
Line 62, "are" should read -- is --.

Column 7,
Line 10, "of" (first occurrence) should read -- on --.
Line 26, "the" should be deleted, and "cannot." should read -- cannot realize the stable BTHJ ejection. --.

Signed and Sealed this

Thirtieth Day of July, 2002

*Attest:*

*Attesting Officer*

JAMES E. ROGAN
*Director of the United States Patent and Trademark Office*